US005438687A

United States Patent [19]

Suchowerskyj et al.

[11] Patent Number: 5,438,687

[45] Date of Patent: Aug. 1, 1995

[54] SYSTEM FOR SELECTING ROUTE-RELEVANT INFORMATION WHEN USING THE RADIO DATA SYSTEM (RDS)

[75] Inventors: Wadym Suchowerskyj, Hildesheim; Jürgen Kaesser, Diekholzen; Peter Braegas, Hildesheim, all of Germany

[73] Assignee: Robert Bosch GmbH, Stuttgart, Germany

[21] Appl. No.: 99,165

[22] Filed: Jul. 29, 1993

[30] Foreign Application Priority Data

Sep. 10, 1992 [DE] Germany ..... 42 30 294.3

[51] Int. Cl.[6] ..... A04B 17/02; G08G 1/09

[52] U.S. Cl. ..... 455/158.4; 455/186.2; 455/345; 340/905; 345/157

[58] Field of Search ..... 345/133, 160, 156, 168, 345/157; 340/905, 990, 995; 455/37.1, 38.1, 38.4, 38.5, 67.7, 89, 90, 154.1, 156.1, 154.2, 158.4, 161.1, 166.2, 185.1, 186.1, 186.2, 344, 345; 379/58, 59

[56] References Cited

U.S. PATENT DOCUMENTS

| | | | |
|---|---|---|---|
| 4,862,513 | 8/1989 | Brägas et al. | 455/45 |
| 4,893,127 | 6/1990 | Clark et al. | 340/995 |
| 5,020,143 | 5/1991 | Duckeck et al. | 455/186 |
| 5,065,452 | 11/1991 | Duckeck et al. | 455/226 |
| 5,095,532 | 3/1992 | Mardus et al. | 455/186 |
| 5,152,012 | 9/1992 | Schwob | 455/161.2 |
| 5,182,555 | 1/1993 | Summer | 340/995 |
| 5,193,214 | 3/1993 | Mardus et al. | 455/54.2 |
| 5,214,793 | 5/1993 | Conway et al. | 340/905 |
| 5,293,163 | 3/1994 | Kakihara et al. | 340/995 |

FOREIGN PATENT DOCUMENTS

| | | |
|---|---|---|
| 0300205A2 | 1/1989 | European Pat. Off. . |
| 3810180 | 10/1989 | Germany . |
| 3914104 | 11/1990 | Germany . |

OTHER PUBLICATIONS

Peter Brägas, "With Traffic Guidance Systems Against Total Traffic Collapse," *Man Forum* magazine, Jan. 1991, pp. 26–29, published by M. A. N. Aktiengesellschaft, Munich, Germany.

Wadym Suchowerskyj, *Vehicle Navigation and Information Systems in Europe,* Proceedings of the International Congress on Transportation Electronics, pp. 210–215, Oct. 1990, Warrendale, Pa.

*Primary Examiner*—Reinhard J. Eisenzopf
*Assistant Examiner*—Lisa Charouel
*Attorney, Agent, or Firm*—Frishauf, Holtz, Goodman & Woodward

[57] ABSTRACT

Traffic Condition information is settled by actuating a key (15, 16, 17, 18) of a four-way toggle switch (8) of a radio receiver in order to specify a directional quadrant. The position (34) of the radio receiver is established by the computer (5), using program comparison and identification methods, and traffic conditions information relating to the selected directional quadrants (30, 31, 32, 33) is issued via an output device (11), for example visually by a display or acoustically via loudspeakers (10) with the aid of a voice synthesizer (7).

13 Claims, 4 Drawing Sheets

SYSTEM FOR SELECTING ROUTE-RELEVANT INFORMATION WHEN USING THE RADIO DATA SYSTEM (RDS)

CROSS-REFERENCE TO RELATED PATENTS, THE DISCLOSURE OF WHICH ARE INCORPORATED BY REFERENCE

U.S. Pat. No. 4,862,513, Brägas, issued Aug. 29, 1989, entitled RADIO RECEIVER WITH TWO DIFFERENT TRAFFIC INFORMATION DECODERS;

U.S. Pat. No. 5,065,452, Brägas & Duckeck, issued Nov. 12, 1991, entitled DIGITAL TRAFFIC NEWS EVALUATION METHOD;

U.S. Pat. No. 5,095,532, Mardus, entitled METHOD & APPARATUS FOR ROUTE-SELECTIVE REPRODUCTION OF BROADCAST TRAFFIC ANNOUNCEMENTS;

U.S. Pat. No. 5,020,143, Duckeck & Brägas, issued May 28, 1991;

U.S. Pat. No. 5,193,214, Mardus, Duckeck & Brägas, issued Mar. 9, 1993, VEHICULAR RADIO RECEIVER WITH STANDARD TRAFFIC PROBLEM DATABASE.

FIELD OF THE INVENTION

The invention relates to a method of selecting information relevant to one's desired route, when using the Radio Data System (RDS) defined by the European Broadcasting Union in Brussels.

BACKGROUND

An RDS method is known, wherein traffic messages, in a coded form and identifying the relevant location(s), are transmitted simultaneously with the radio program. A radio receiver with a decoder receives an audio program, as well as the coded and digitized traffic information. In contrast to the ARI system (U.S. Trademark Reg. No. 1,282,281, owned by Bosch subsidiary Blaupunkt Werke GmbH), the radio does not interrupt the current audio program. Instead, the radio stores the coded traffic information and, when a key is activated, outputs it visually, by means of an output device, or acoustically by means of speakers.

Furthermore, a device is known from German Published Patent Application DE-OS 39 36 577, Duckeck & Brägas, and corresponding U.S. Pat. No. 5.303,401,issued Apr. 12, 1994, which device determines the position of the radio receiver by comparing the received transmission frequencies with frequency tables stored for various regions.

It is also known from Bosch Technische Berichte [Bosch Technical Reports] (Vol. 8, issue 1/2 of 1986, pages 15 ff, entitled "Transmission of Coded Traffic Bulletins over FM stations using RDS") that, after the exact travel route has been entered, the driver has an opportunity to have a computer select the traffic information relating to the entered travel route.

In the latter method, it is necessary to establish a definite travel route before starting. This system also requires a special coding process, in accordance with which the roads and places along the travel route must be identified and entered by the driver. Furthermore, there is no chance for the driver to monitor the traffic situation along another travel route and to use an alternate travel route, if warranted by the traffic conditions.

THE INVENTION

In contrast to the above, the present invention has the advantage that it is only required to enter a directional quadrant. Another advantage is to be seen in that it is often possible to utilize an already-provided piece of equipment, namely the four-way toggle switch of the radio receiver, and no additional keypad for entering the direction of travel is necessary. The selection of the travel direction by means of the keys of the four-way toggle switch is easily managed, does not distract the driver from watching the traffic, and does not require knowledge of a special input method. It is considered to be an additional advantage that all traffic information relating to the chosen directional quadrant is selected by the computer and is output by means of the display unit, so that the driver receives a good overview of the traffic conditions in the desired direction of travel and is informed generally, not merely about one particular route. This makes it possible for the driver to select an alternate routing if traffic conditions require it.

It is particularly advantageous that it is possible, with a single actuation of the four-way toggle switch, to select a directional quadrant with a radius of defined size for selecting traffic information, which radius can be enlarged by a defined amount with every additional actuation of the key or zone. In this way, it is possible to enter in a simple manner a distance radius, of a size especially adapted for the intended trip.

The included angle of the directional quadrant is suitably set to 90°, because in this way all possible travel directions are covered, without overlap, by the four keys of the four-way toggle switch; one could of course substitute four actuations of one key. Other manual actuation means having multiple actuation zones, e.g. digitizing pads or touch-screens, are alternate possibilities.

The assignment of the key disposed at the top in the axial plane of the four-way toggle switch with the directional quadrant extending from the northwest to the northeast, of the key disposed on the right with the directional quadrant extending from the northeast to the southeast, of the key disposed at the bottom with the directional quadrant extending from the southeast to the southwest, and of the key disposed on the left with the directional quadrant extending from the southwest to the northwest appears to be particularly practical, since it corresponds with the arrangement of a geographic map, and makes intuitive sense to all drivers. It therefore can be employed by all drivers, with only a small quota of errors.

A further advantageous step consists in dividing the traffic area into square rectangles. In this way, a single actuation of one key of the four-way toggle switch causes the computer to establish the square in which the vehicle is located and, with each further actuation of the key, to increase the directional quadrant by the squares located at least partially in the selected directional quadrant and adjoining the already selected traffic area. This method allows the management of the traffic area by squares. It has the advantage that the computer can decide rapidly and simply whether or not the places or road segments affected by the traffic information are located in the selected square, e.g. by comparing X–Y coordinates with range values.

A practical further development of the method consists in dividing the traffic area into overlapping square rectangles which preferably consist of the traffic areas of the TMC (Traffic Message Channel) location code table, which is known from literature published by the European Broadcasting Union. In this way, it is possible to utilize the already known formation of the TMC location code table.

It is practical to establish the new identification of the position of the radio receiver at set intervals, and to use the newly established position as the apex or starting point for the new directional quadrant, because in this way the directional quadrant is aligned with the respective position of the radio receiver. This can possibly be done by key actuation or automatically, for example in accordance with time or travel distance segments.

It is particularly advantageous for the computer to arrange the traffic information relating to the selected directional quadrant by priority and to output it, starting with the highest priority. In this way, the most important traffic information is forwarded to the driver most rapidly, which may be of importance if, for example, there is a wrong-way driver coming down his or her lane of the superhighway.

The high traffic density, and the resultant large degree of attention the driver has to pay to traffic conditions, makes it appear as particularly practical to issue the traffic information acoustically. In this way, the driver does not need to take his or her eyes away from the actual traffic, in order to read traffic information from a display, for example.

Since, in spite of the selection among traffic bulletins by choosing a directional quadrant, a large amount of traffic bulletins occur, it appears to be practical, during trips of greater distance, to output only those traffic bulletins whose priority exceeds a predetermined threshold.

DRAWINGS

An exemplary embodiment of the invention is illustrated in the drawings and explained in detail in the following description.

Figure 1:
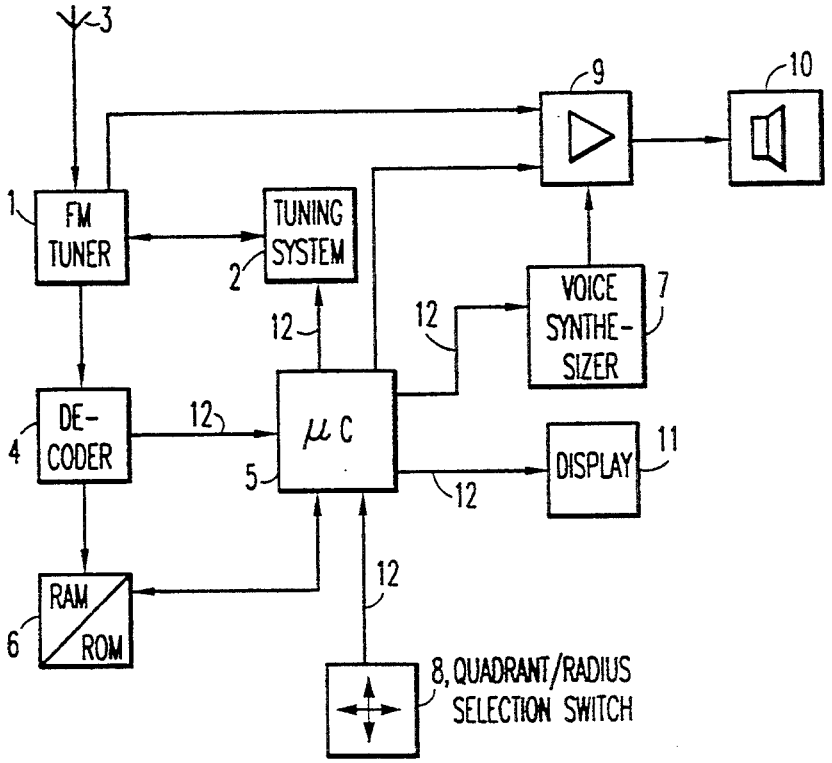
FIG. 1 shows an RDS radio receiver with associated components.

DETAILED DESCRIPTION:

A computer 5 is shown in FIG. 1, which is connected via data lines 12 with a tuning system 2, a decoder 4, a memory 6, a voice synthesizer 7, a four-way toggle switch 8, an amplifier 9 and an output device 11. The tuning system 2, in turn, is connected with an FM tuner 1 and an amplifier 9. The FM tuner 1 itself is connected with an antenna 3, the decoder 4, and the amplifier 9, the latter being connected with the loudspeakers 10. Computer 5 is suitably any of the microprocessors commonly used in vehicle radio receivers having digital memory components.

Furthermore, there is a connection between the decoder 4 and the memory 6. The computer 5 selects the desired transmitter at the FM tuner 1 via the tuning system 2. In addition, by means of the amplifier 9, the computer sets the volume requested by the driver. Via the antenna 3, the FM tuner 1 receives the radio program transmitted by the selected transmitter and the coded, digitized traffic information through the TMC channel. The TMC or Traffic Message Channel is a particular implementation of the Transparent Data Channel defined in the RDS standard.

If the driver selects the TMC function in an RDS radio, for example, the radio transmission is output to the driver with the aid of the amplifier 9 through the loudspeakers 10, while the coded traffic information is received by the RDS decoder 4, stored in the memory 6, and the driver is made aware that traffic information has been received. Among other information, the memory 6 contains tables with the frequencies of the radio transmitters and tables with the assignment of the receiving frequencies of the transmitters to the reception areas.

In addition, a road map containing large cities and important traffic points is stored in a digitized manner in the memory 6. The driver can enter a directional quadrant with the aid of the four-way toggle switch 8, on the basis of which the computer 5 selects out those traffic bulletins, received by the decoder 4, which relate to the selected directional quadrant.

The computer 5 now indicates on the output device 11 that traffic bulletins related to the selected directional quadrant have been received, and can be output in accordance with priority. The driver has the opportunity to select the mode of output, so that the traffic information can be issued either acoustically, by means of the loudspeakers 10, or visually, via the output device 11.

Figure 2:
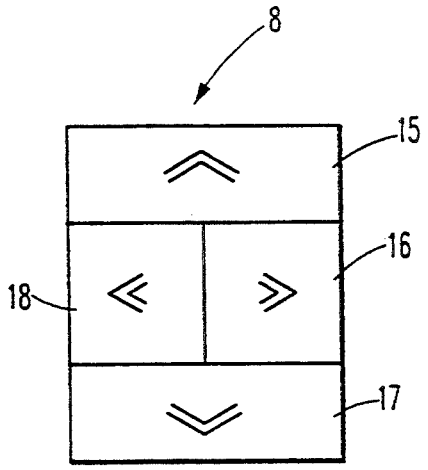
FIG. 2 shows a standard radio-panel four-way toggle switch.

FIG. 2 shows a four-way toggle switch with four keys, the keys being arranged in the form of an axial cross. The directional quadrant northwest through northeast 30 is assigned to the key 15 located at the top, the directional quadrant northeast through southeast 31 to the key 16 located on the right, the directional quadrant southeast through southwest 32 to the key 17 located at the bottom and the directional quadrant southwest through northwest 33 to the key 18 located on the left.

Figure 3:
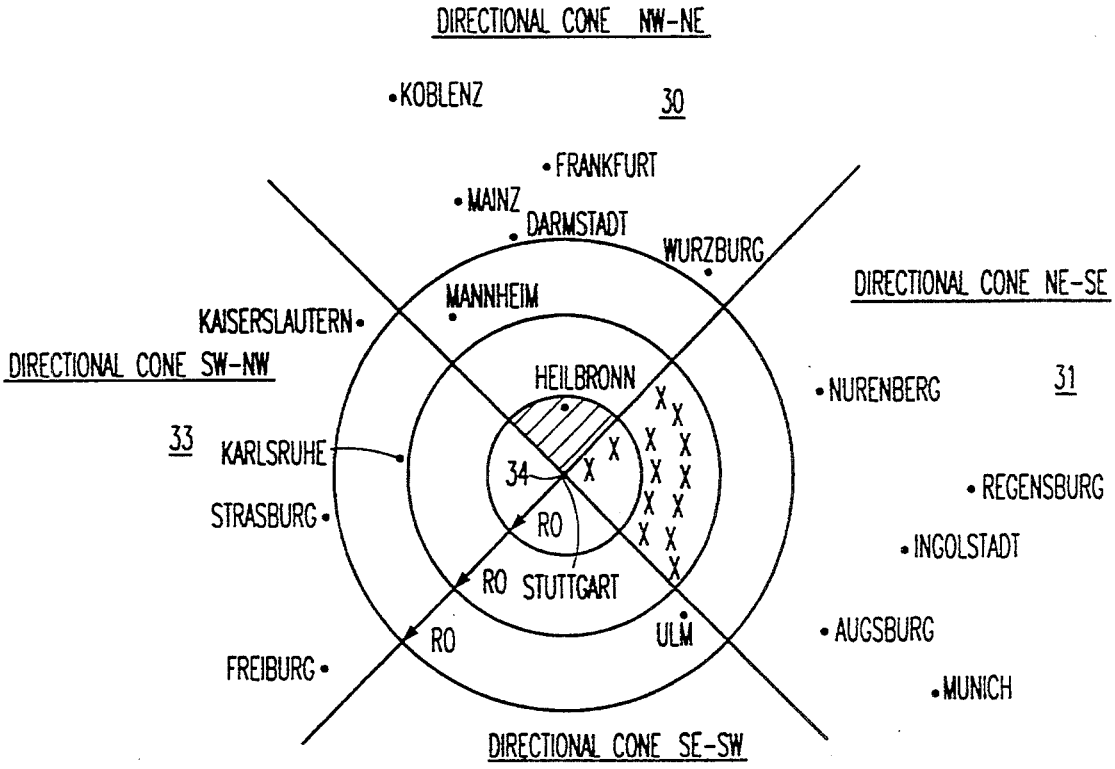
FIG. 3 is a schematic representation of a map with directional quadrants and distance zones.

FIG. 3 illustrates the subdivision of the route map into directional cones, preferably quadrants. The radio receiver current location 34 is in Stuttgart, at the apex of each cone. In addition, distance zones, which can be selected by repeated actuation of the keys 15, 16, 17, 18 of the four-way toggle switch 8 or other manual actuation means, are drawn in as circles.

Figure 4:
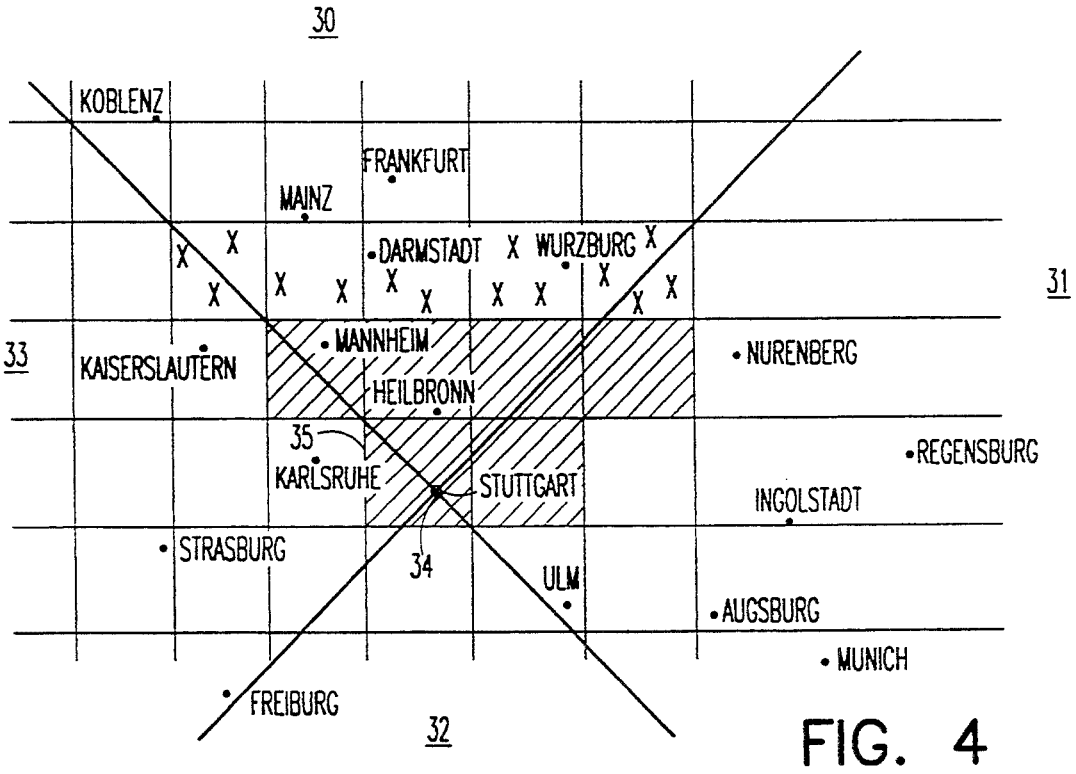
FIG. 4 is a schematic representation of a map with a square grid or raster division.

FIG. 4 illustrates the subdivision of the map into a square grid. If the driver selects the directional quadrant northwest to northeast by a single actuation of the key 15 located at the top of the four-way toggle switch 8, the area of location square 35, in which the receiver and the adjoining squares at least partially located in the selected directional quadrant 30 and adjoining the location square 35 are located, is established as the area selected for traffic information. The selected area for this example is shown hatched in FIG. 4. If the top key 15 of the four-way toggle switch 8 is actuated twice, the area shown hatched in FIG. 4, plus the one marked by X's, is established as the selected area.

Figure 5:
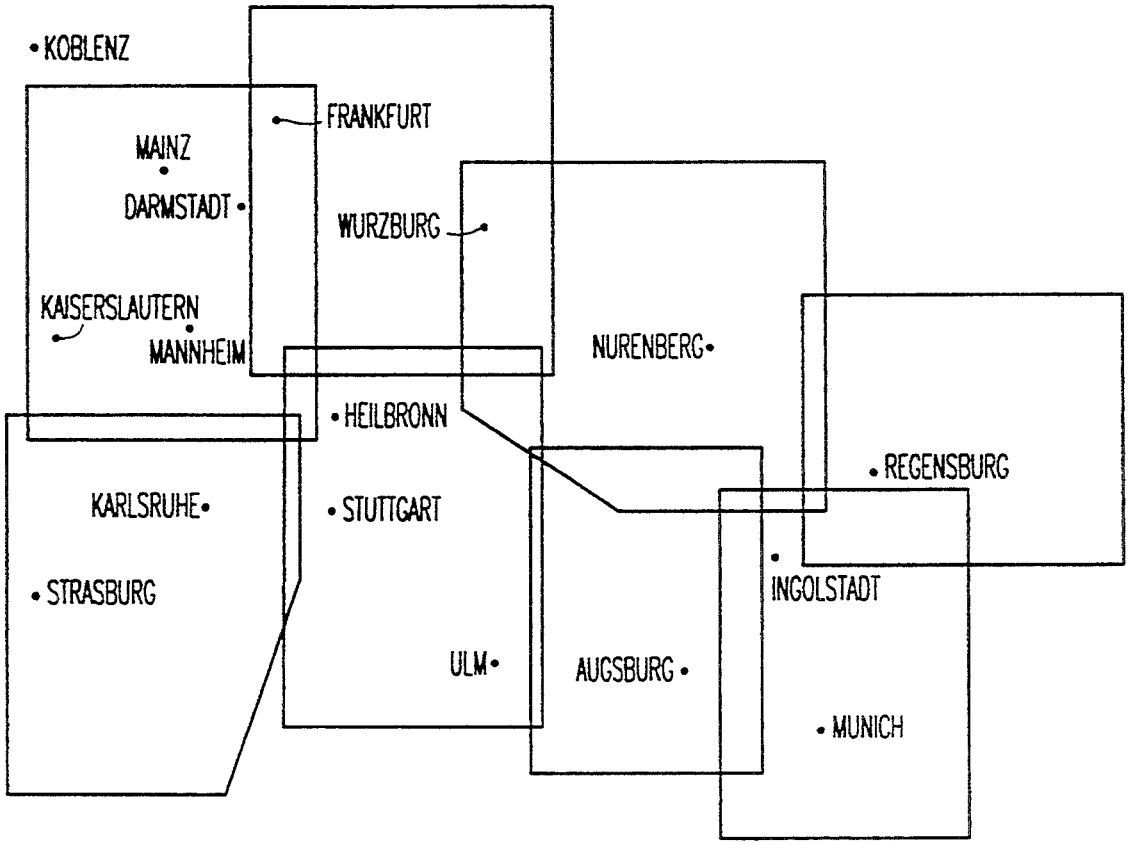
FIG. 5 is a schematic representation of a map with overlapping traffic areas of the Traffic Message Channel (TMC) location code table.

The division of the map into traffic areas of the TMC location code table is represented schematically in FIG. 5. The overlapping traffic areas of the TMC location code indicate areas which are linked by traffic, and the extent of which can be found in the TMC look-up table.

MODE OF OPERATION

Figure 6:
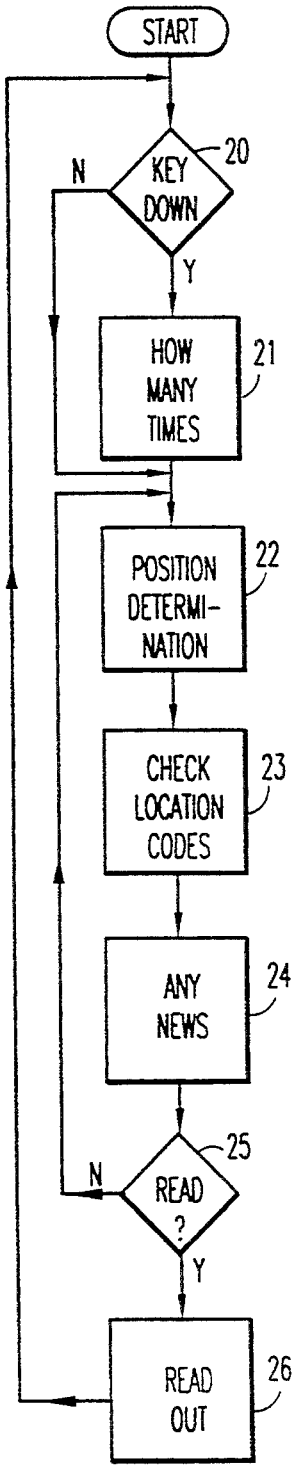
FIG. 6 is a flowchart representing the mode of operation of the method of the present invention.

The mode of functioning of the selected exemplary embodiment is explained by means of the flowchart of FIG. 6 and by FIG. 3.

At program step 20, the computer 5 waits for a preset length of time for the actuation of a key of four-way toggle switch 8. If no key is actuated during the preset length of time, the program jumps to program step 22 and continues. But if a key is actuated, it is determined at program step 21 which key of the toggle switch has been actuated and how often this key had been actuated within five seconds. For example, if the vehicle is in Stuttgart and the driver actuates the key 15 located at the top of the four-way toggle switch 8 once, the driver selects a directional quadrant 30 extending from northwest to northeast and having a radius of a predetermined size Ro, which is shown diagonally hatched in FIG. 3. If the driver twice actuates the key 16 located on the right of the four-way toggle switch 8, for example, a directional quadrant 31 is established by this, which extends from northeast to southeast and has a radius twice the size (2×Ro). In FIG. 3, this area is shown filled with X's.

Actuating a key of the four-way toggle switch three times causes the establishment of a directional quadrant of three times the size (3×Ro) and the output of only those traffic bulletins, the priority of which exceed a fixed value. Now, if the directional quadrant was established at program step 21, the determination of the position of the radio receiver is made at program step 22. Through the transmitter frequencies and transmitter reception areas stored in the memory 6, the computer 5 can determine the position with the aid of the correlation method, the exclusion method and the Program Comparison Identification (PCI) method (see DE-OS 39 36 577 and corresponding U.S. Pat. No. 5,303,401). With the position and the specification of the directional quadrant, the area for selecting the traffic information is now clearly established.

At program step 23, the computer 5 selects, from among all bulletins received by the decoder 4, those relating to the surrounding traffic area, and stores them in RAM memory 6. Location codes are transmitted together with the traffic information, which contain the identification of the place or the road segment in the traffic bulletin. These location codes are examined by the computer 5 to determine whether they are located in the selected directional quadrant. At program step 24, the computer 5 indicates to the driver, via the output device 11, whether traffic information relating to the selected directional quadrant has been received. The computer 5 then waits at program location 25 for the driver to state whether traffic information is to be output. If this is not the case within a preset length of time, it returns back to program location 22 and runs again through program steps 22 to 25. But if, at program step 25, the driver actuates the key 15 located at the top of the four-way toggle switch, the computer 5 outputs the traffic information in step 26. It does this acoustically, with the aid of the voice synthesizer 7 via the loudspeakers 10, if the key 15 has been actuated once or, upon actuation of the key 15 twice, visually by means of the output device 11, for example a display. After that, it returns to program location 20, and again runs through the program.

Various changes and modifications may be made, and features described in connection with any one of the embodiments may be used with any of the others, within the scope of the inventive concept.

What is claimed is:

1. In a radio system for receiving traffic bulletins which include a code identifying a location to which each bulletin relates, comprising a mobile radio receiver (1, 9, 10);

computer means (4, 5, 6) for determining current location (34) of said receiver and for processing said traffic bulletins;

manual actuation means (8) for input of criteria for selection among bulletins received by said receiver; and means (7, 9, 10, 11), coupled to an output of said computer means, for indicating selected bulletins to a user, the improvement wherein said manual actuation means has a plurality of actuation zones (15, 16, 17, 18), each of which is associated with a respective conical area or set of traffic bulletin locations (30, 31, 32, 33), extending outward from an apex (34) at said receiver location; and said computer means is responsive to actuation of one of said actuation zones (15, 16, 17, 18) to selectively output, via said indicating means, traffic bulletins whose location code identifies a location falling within the conical area (30,31,32,33) associated with the actuation zone which was actuated.

2. The radio system of claim 1, wherein said plurality of actuation zones respectively comprise four keys (15, 16, 17, 18) and each conical area is a directional quadrant.

3. The radio system of claim 2, wherein said manual actuation means is a four-way toggle switch (8).

4. A system in accordance with claim 3, wherein said computer means is responsive to actuating a key (15, 16, 17, 18) of the four-way toggle switch (8) once so that a radius of preset value for selecting the traffic information is assigned to the directional quadrant (30, 31, 32, 33) thus established, and with each subsequent actuation of this key (15, 16, 17, 18) the radius is respectively increased by a preset value.

5. A system in accordance with claim 3, wherein said directional quadrant (30, 31, 32, 33) having an opening angle of 90° is assigned to each key ( 15, 16, 17, 18 ) of the four-way toggle switch (8).

6. A system in accordance with claim 3, wherein the four keys (15, 16, 17, 18) of said toggle switch (8) are arranged in a generally cross-shaped configuration having opposed top and bottom and opposed right and left;

a directional quadrant NW to NE (30) is assigned to the key (15) located at the top of the four-way toggle switch, a directional quadrant NE to SE (31) is assigned to the key (16) located at the right, a directional quadrant SE to SW (32) is assigned to the key (17) located at the bottom; and the directional quadrant SW to NW (33) is assigned to the key (18) located at the left.

7. A system in accordance with claim 3, wherein a traffic area is divided into squares, and said computer means is responsive to identify as a location square whichever one of said squares said receiver is located in by a one-time actuation of a key (15, 16, 17, 18) of the four-way toggle switch (8).

8. A system in accordance with claim 7, wherein the location square (35) and squares adjoining thereto, which are at least partially located in the directional quadrant of the actuated key, are determined by the computer means as a selected area, and with each subsequent actuation of the key (15, 16, 17, 18), the selected area is respectively increased by the computer means (5) by the squares adjoining the already selected area and located at least partially in the selected directional quadrant (30, 31, 32, 33).

9. A system in accordance with claim 7, wherein the squares are overlappingly located and correspond to traffic areas of a Traffic Message Channel location code table.

10. A system in accordance with claim 3, wherein said computer means determines the current location of the receiver at fixed time intervals to be used as respective starting points of the directional quadrants (30, 31, 32, 33) or selected areas to be newly established in this way.

11. A system in accordance with claim 3, wherein the computer means (5) arranges the selected traffic bulletins by priority and outputs them visually or acoustically, starting with whichever of said bulletins is assigned a highest priority.

12. A system in accordance with claim 3, wherein when the directional quadrant (30, 31, 32, 33) or a selected area with a radius or extension of a set size has been selected, the computer means (5) only outputs those traffic bulletins having a priority which exceeds a set value.

13. A system in accordance with claim 3, wherein said computer means determines the current location of the receiver as its position changes by certain distance segments to be used as respective starting points of the directional quadrants (30, 31, 32, 33) or selected areas to be newly established in this way.

* * * * *